US005129307A

United States Patent [19]

Cain et al.

[11] Patent Number: 5,129,307

[45] Date of Patent: Jul. 14, 1992

[54] SIDE-MOUNTED ROLLING AIRFRAME MISSILE LAUNCHER

[75] Inventors: R. Neal Cain, Fredericksburg; Gary L. Carle, King George; Walter H. Klaus, Dahlgren, all of Va.

[73] Assignee: United States of America as represented by the Secretary of the Navy, Washington, D.C.

[21] Appl. No.: 739,262

[22] Filed: Aug. 1, 1991

[51] Int. Cl.[5] ..... F41A 27/06; F41F 3/04; F41G 5/20

[52] U.S. Cl. ..... 89/1.815; 89/36.13; 89/41.14

[58] Field of Search ..... 89/41.14, 37.01, 36.13, 89/1.8, 1.815, 1.816

[56] References Cited

U.S. PATENT DOCUMENTS

| | | | |
|---|---|---|---|
| 2,960,009 | 11/1960 | Hereth et al. | 89/37.01 |
| 3,048,087 | 8/1962 | Campbell | 89/41.14 |
| 4,114,512 | 9/1978 | Schwendt | 89/36.13 |
| 4,346,644 | 8/1982 | DeHaven et al. | 89/37.03 |
| 4,541,323 | 9/1985 | Sadler et al. | 89/41.14 |

*Primary Examiner*—David H. Brown

*Attorney, Agent, or Firm*—John D. Lewis; Kenneth E. Walden

[57] ABSTRACT

An integrated sidemounting of a rolling airframe missile launcher with a 5"/54 MK-45 gun mount is provided. The integrated gun-missile system permits simultaneous tracking of the missile system and gun system and, through software systems, allows the ship's defensive system to automatically sequence through weapons as required. Chaff, decoys and flares may also be launched using the side-mounted missile launcher.

3 Claims, 8 Drawing Sheets

SIDE-MOUNTED ROLLING AIRFRAME MISSILE LAUNCHER

ORIGIN OF THE INVENTION

The invention described herein was made in the performance of official duties by employees of the Department of the Navy and may be manufactured, used, or licensed by or for the Government, for any governmental purpose without payment of fees or any royalties thereon.

BACKGROUND OF THE INVENTION

1. Field of the Invention

The invention relates to missile launch system and more particularly to missile launch systems which are integrated with gun systems.

2. Description of Prior Art

Rolling airframe missile launchers are currently mounted independently on various ships. The intensity of the air threat, both missile and aircraft, against surface ships requires an in-depth defense using a mix of missile and gun systems. Typically, defense requires a large volume of high acceleration short range missiles and high rate-of-fire guns.

Current systems provide adequate defense at longer ranges, up to the point of saturation of the ship's defensive system, by high volume attacks. The near range defense is accomplished by high rate-of-fire automated guns. The capability at near range is a last ditch effort which has a lower success rate than the greater range defenses. A gap now exists between the maximum effective range for close-in short range defense and the minimum range for missile engagement. A short range, highly maneuverable missile is needed to engage targets beyond gun range but short of the current minimum range provided by longer range missiles.

SUMMARY OF THE INVENTION

It is an object of the present invention to provide missile launch capabilities to existing MK-45 guns.

It is another object of the present invention to provide integrated aiming and fire control to rolling airframe missile and MK-45 guns.

It is yet another object of the invention to provide a trainable launcher for decoy and chaff deployment.

The invention is an integrated sidemounting of a rolling airframe missile launcher, referred to herein as Sideshooter, with a 5"/54 MK-45 gun mount. The integrated gun-missile system permits simultaneous tracking of the missile system and gun system and through software systems allows the ship's defensive system to automatically sequence through weapons as required.

BRIEF DESCRIPTION OF THE DRAWINGS

The foregoing objects and other advantages of the invention will be better understood from the following description taken with the accompanying drawings wherein like reference numerals refer to the same element throughout and wherein.

DETAILED DESCRIPTION OF THE INVENTION

Figure 1:
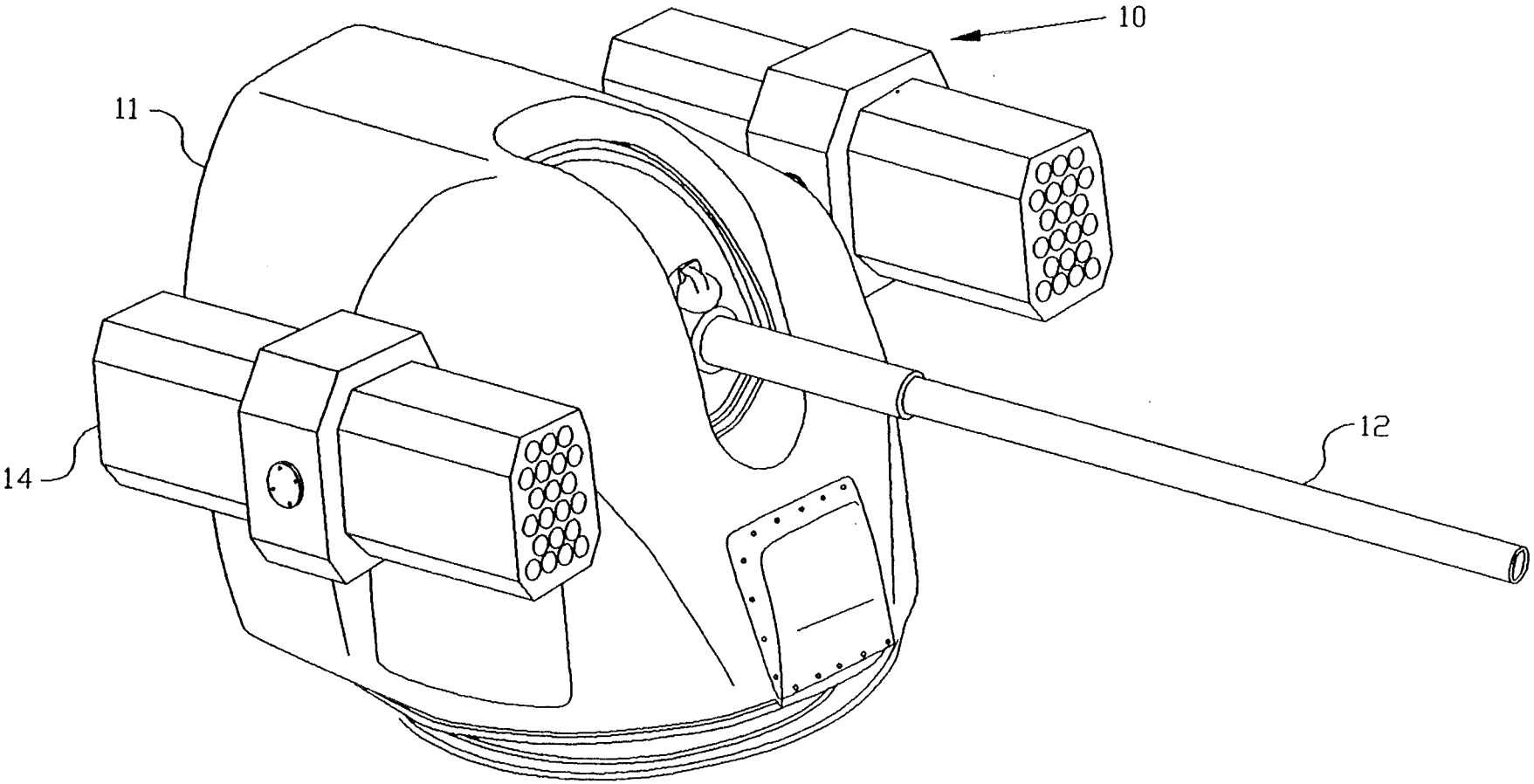
FIG. 1 is a perspective view of the MK-45 Gun with the Side-Mounted RAM Launchers installed.

Referring now to FIG. 1, the sidemounted rolling airframe missile (RAM) launcher of the present invention, the entire system designated generally by the reference numeral 10, is shown mounted on a 5"/54 MK-45 gun mount 11. The launcher guides 14 are boresighted with and slaved to the MK-45 gun 12. Target tracking with the gun fire control system provides target tracking for the missiles at the same time. The integrated system provides a secondary anti-air and anti-ships missile defense capability of up to forty-two rounds of rolling airframe missiles (RAM) for each MK-45 gun mount.

Figures 2, 2A:
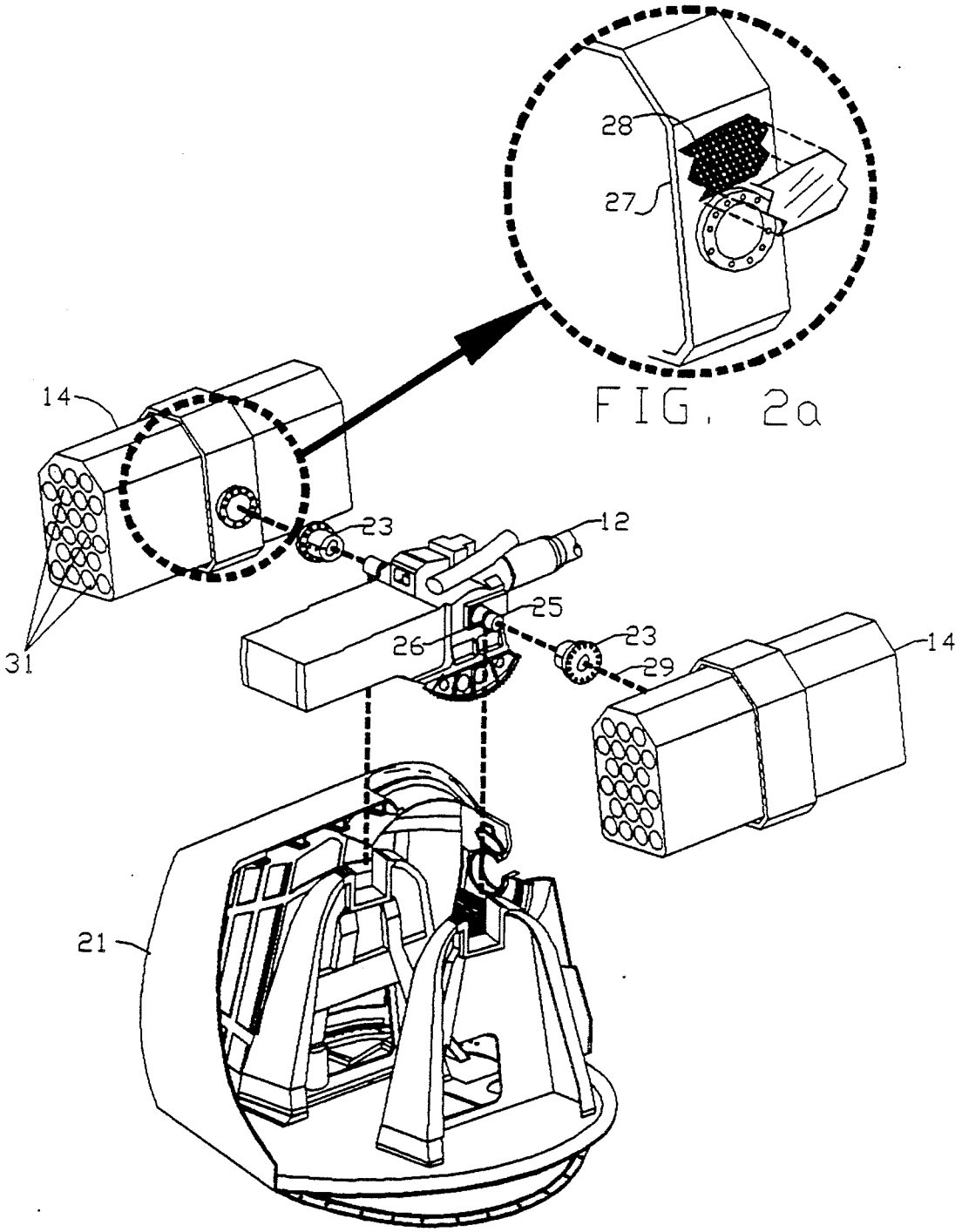
FIG. 2 is a cutaway showing the drive mechanism for elevation control.
FIG. 2*a* is an exploded view of the damping/isolation device of FIG. 2.
Figure 3A:
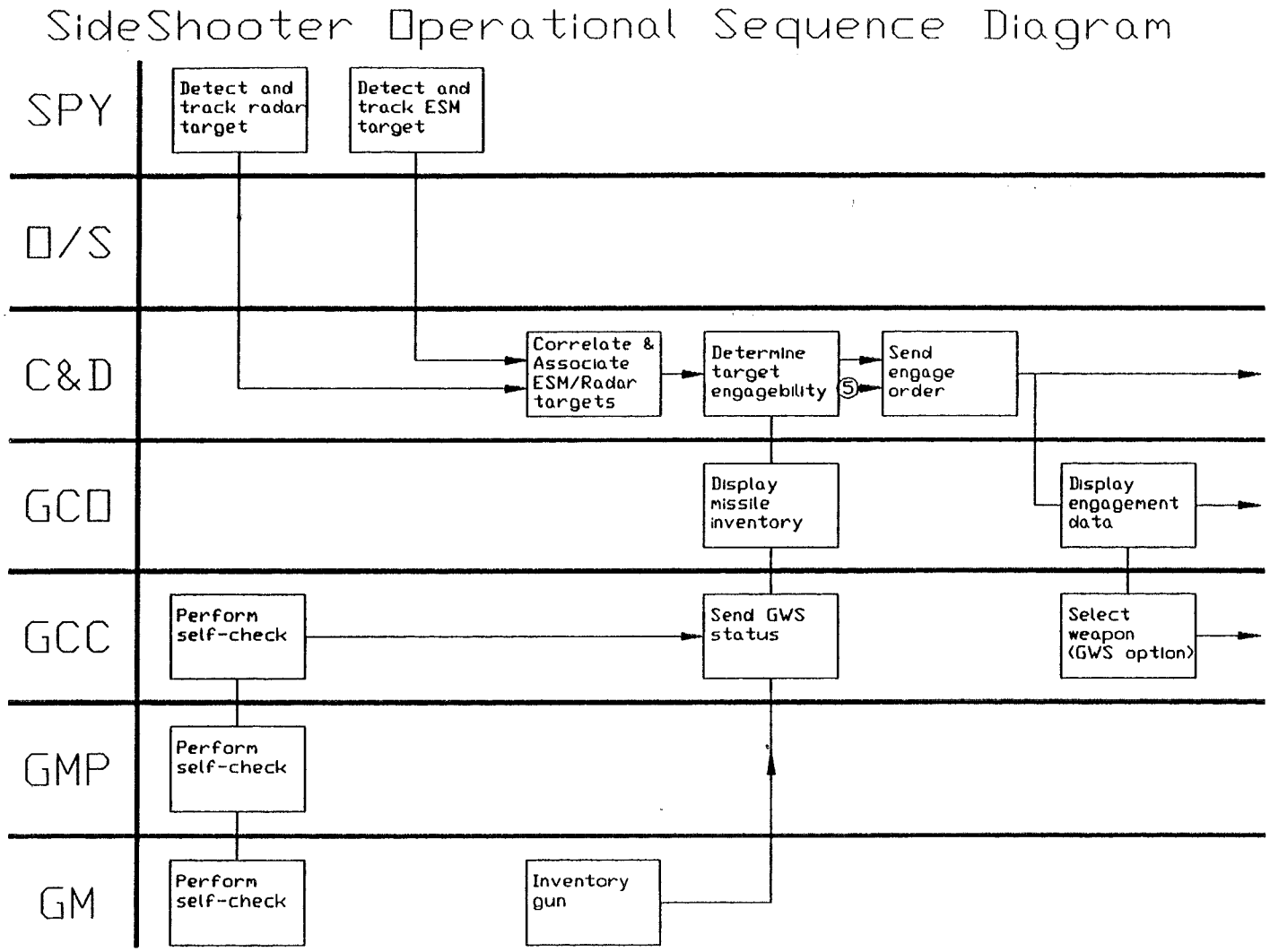
FIG. 3, provided as five sheets 3*a* through 3*e* intended to be aligned end-to-end in a single continuous chart, is a flow chart showing the functional steps of the software controlled integration of the RAM with the gun.
Figure 3B:
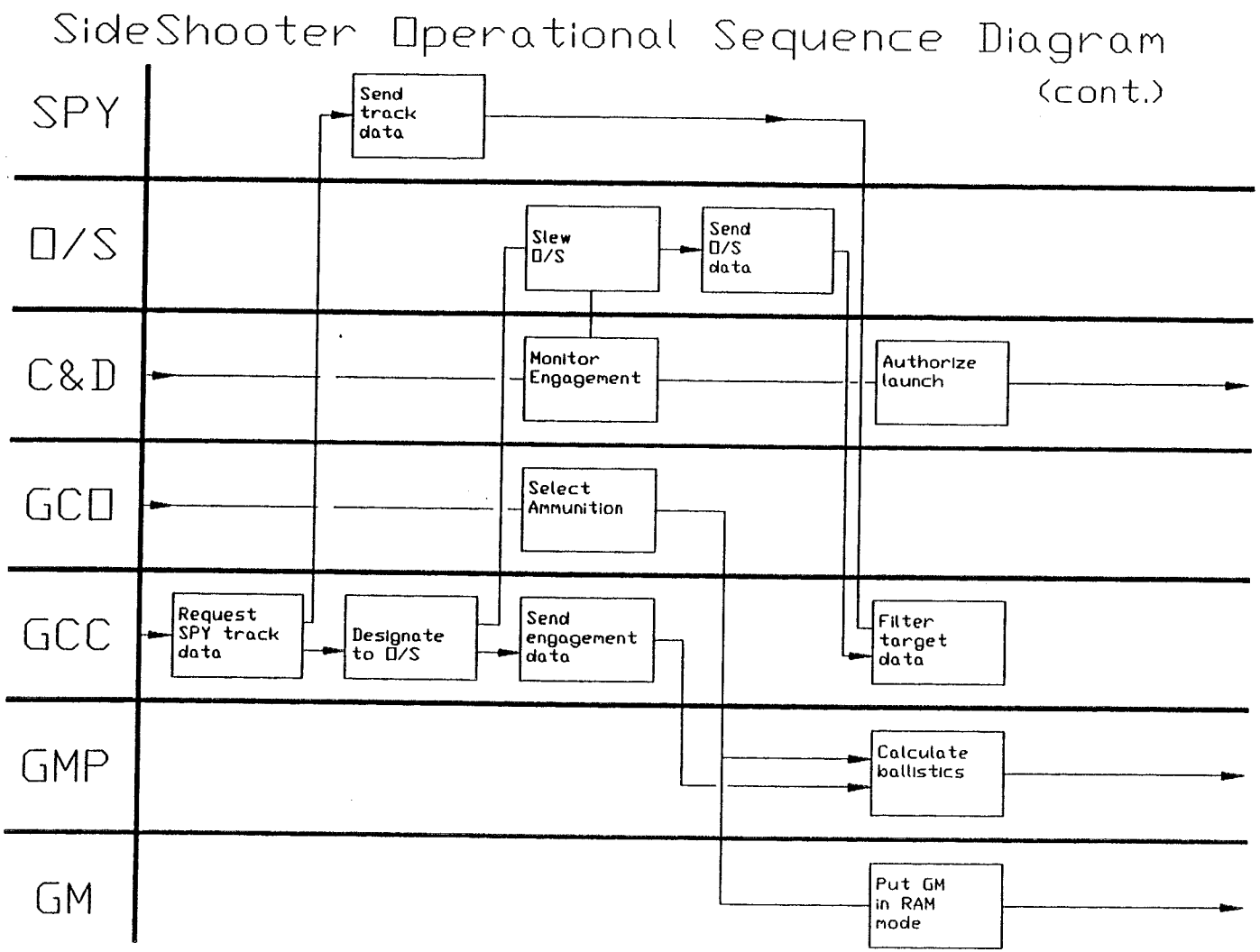
Figure 3C:
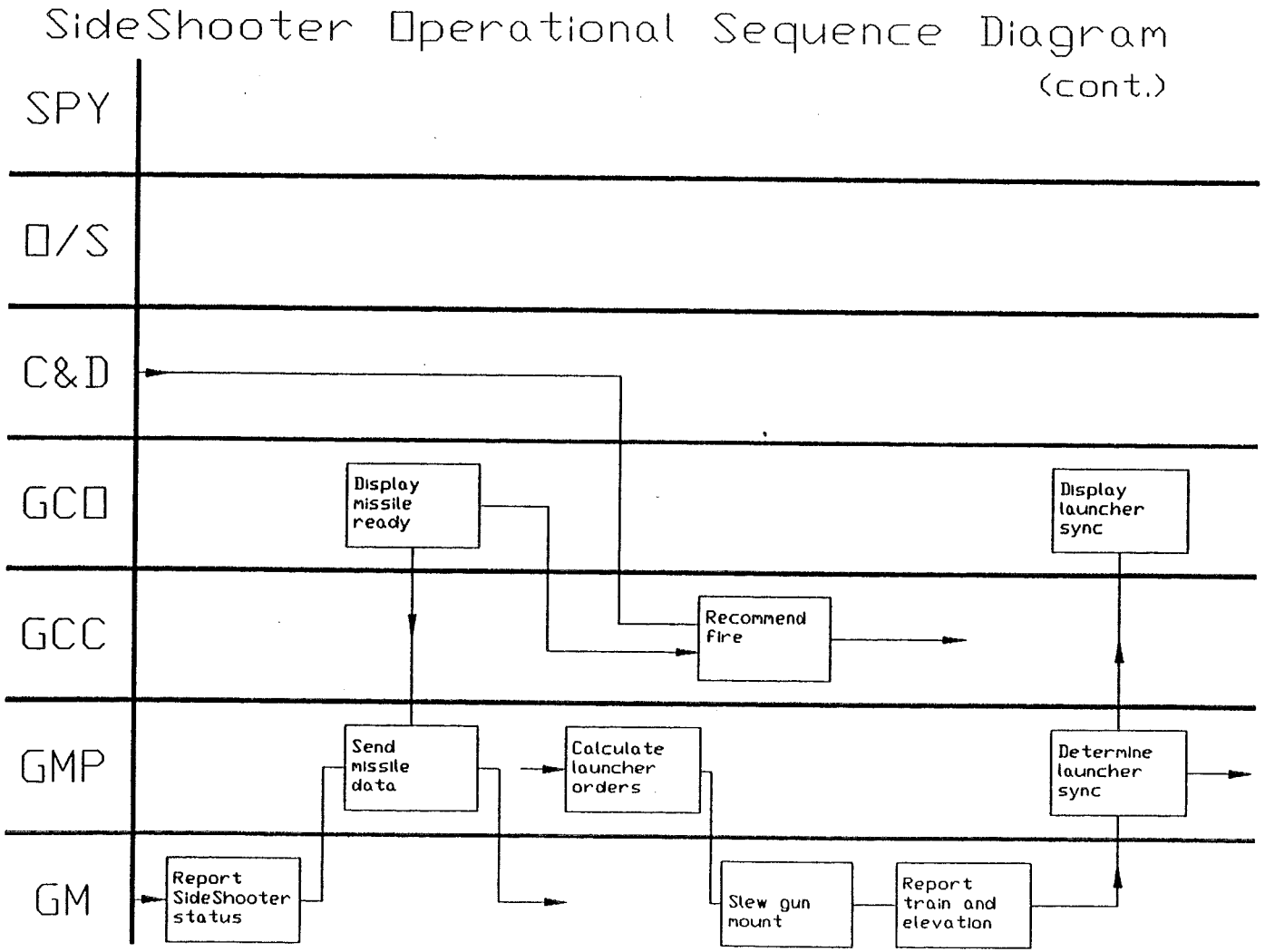
Figure 3D:
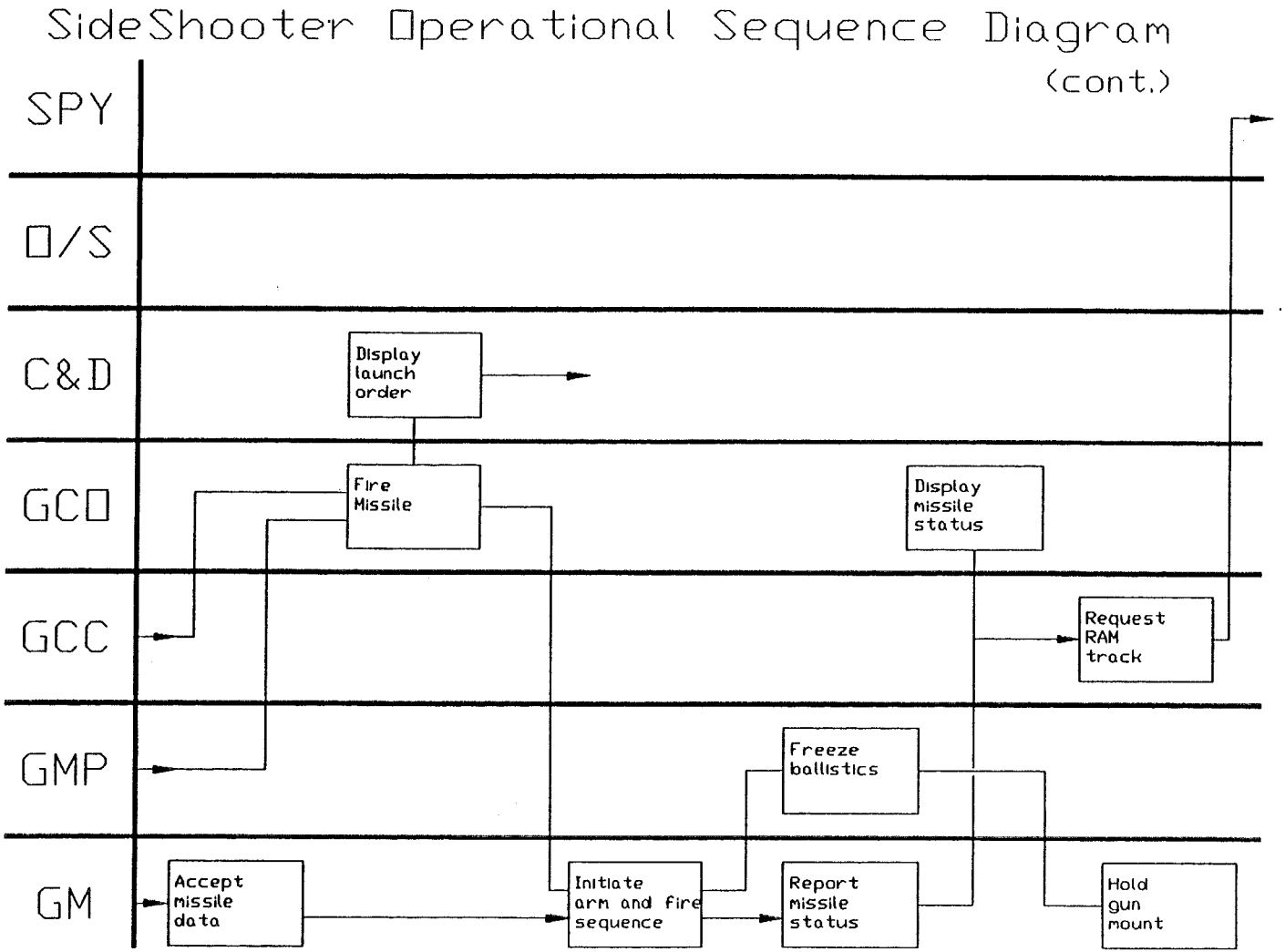
Figure 3E:
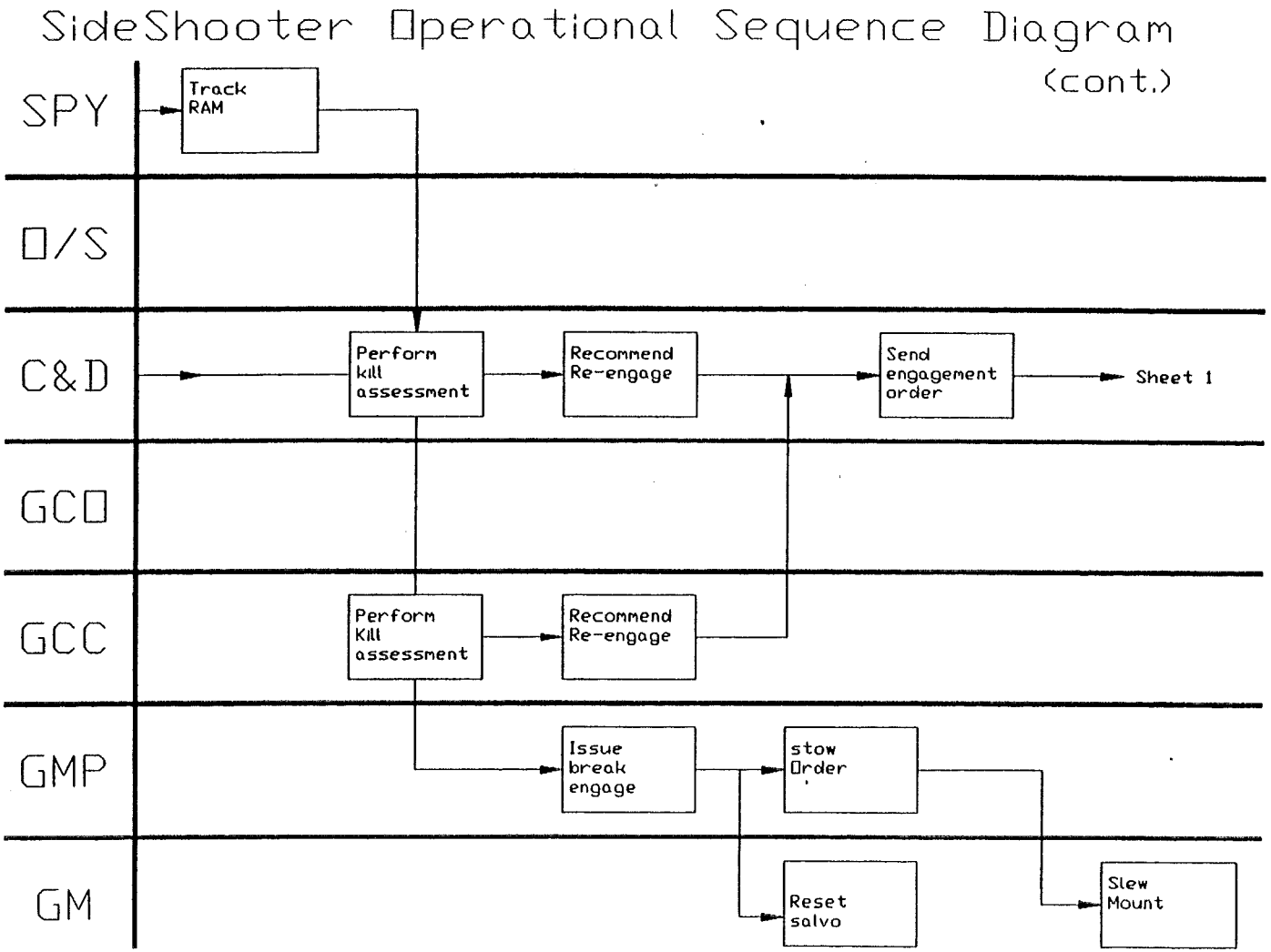

FIG. 2 depicts the preferred embodiment with RAM launcher guides 14 mounted outboard of the gun mount shield 21 using a split sleeve flanged connector 23 from the MK-45 horizontal gun barrel trunion 25. Damping-/isolation device 27 provides a reduction in vibrational and shock loads to the launchers while maintaining sufficient rigidity to provide accurate tracking control during maximum rate elevation and azimuth changes. FIG. 2A shows an exploded view of the damping/isolation device 27 detailing the assembly of the woven wire isolator 28.

Control of individual stores within the launcher guides 14 is accomplished through trunion 25 via actuator cable 29 depicted by dotted line. The cable comprises a 400-volt 22-pair, electrical cable having swivel/flex mechanism 26 which allows rotation of the cable without bending. This feature permits unlimited elevation cycles with no wear or fatigue problems for the electrical cable. Individual initiators 31 provide the firing signals directly to the loaded store. Although the primary load is RAM rounds, a mix of other devices may be loaded, including chaff, flares, and decoys. The individual initiators allow computer store selection by the ship's defensive system without operator intervention.

The ship's defensive system operational sequence is a software controlled automated fire control system which selects target priority based on threat and weapons weight values and further selects defensive weapons to engage these targets. The rapidity of the terminal engagement phase ordinarily precludes manual operation by the weapon operators. The typical sequence is shown functionally in the flow chart in FIG. 3 (provided in five (5) sheets which should be aligned adjacent to one another, 3*a* through 3*e* from the left).

For illustrative purposes, an AEGIS Weapon System configuration similar to that on the DDG-51 class destroyers was assumed. The system components of that system are:

SPY — AEGIS phased array radar for target detection and tracking.

O/S — Optical Sight for target track augmentation and kill assessment.

C&D — AEGIS Command and Decision system.

GCO — Gun Control Operator, controls operation of the GWS.

GCC — Gun Control Computer, GWS control and track processing computer.

GMP — Gun Mount Processor, gun mount control computer.

GM — Mk 45 SideShooter gun mount.

The series of actions during an incoming attack of the ship are characterized by an in-depth defense using multiple, overlapping weapons. The sequencing allows a continuous array of defensive firepower and deception techniques throughout the inbound flight of a hostile target. The initial mid-range defense is accomplished using RAM, transitioning to gun fire, and integrating chaff, flares, smoke and electronic decoys at appropriate ranges.

Figure 4:
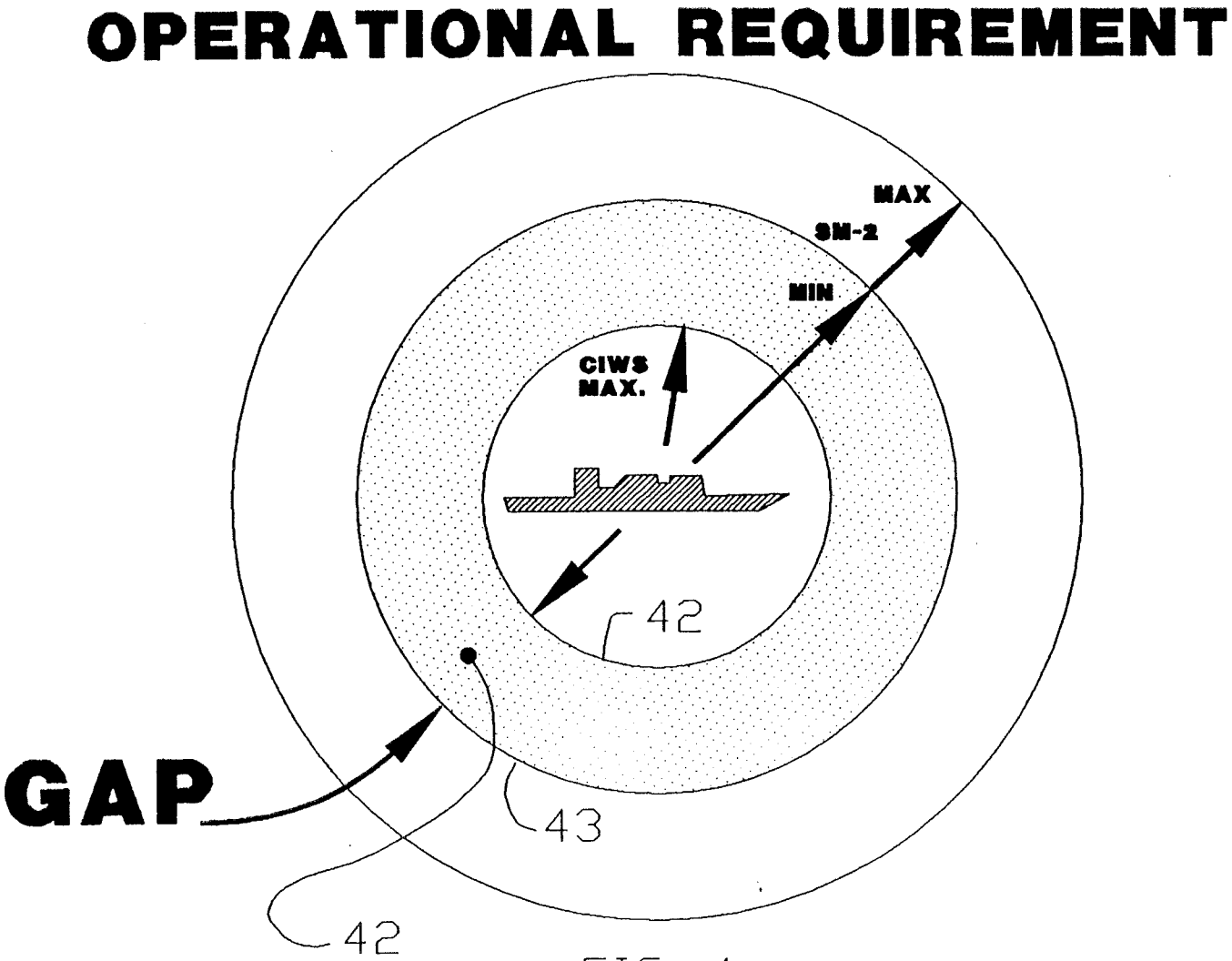
FIG. 4 is a diagram depicting the defensive perimeter around a ship.

The advantages of the present invention are numerous. The integration of the rolling airframe missile with the Mk-45 Gun significantly enhances ship survivability as shown in FIG. 4 by closing the undefended gap 41 between maximum gun range 42 and minimum range of a typical store such as the SM-2 missile. The modifications required to provide the integrated mounting use available off-the-shelf hardware. The modification uses an existing weapons mount and therefore requires no additional deck space and no additional manning.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters and Patents of the United States is:

1. A sidemounted rolling airframe missile launcher for mounting on a 5"/54 MK-45 gun mount comprising:

a pair of split sleeve flanged connectors attached to the outboard ends of the gun barrel trunions;

a damping and vibration-isolating mount with a woven wire isolator attached to each split sleeve flanged connector;

a launcher guide mounted in said damping and vibration-isolating mount;

actuator cables leading through the gun barrel trunions and attaching to individual initiators on said launcher guides;

swivel mechanisms attached to and allowing said actuator cables to rotate while maintaining electrical connection with the gun fire control system; and software systems providing functional control and selection of specific stores within said launcher guides in response to a ships defensive system.

2. A sidemounted rolling airframe missile launcher for mounting on a 5"/54 MK-45 gun mount comprising:

means for mounting rolling airframe missile launchers on a 5"/54 MK-45 gun mount;

means for isolating vibration between said means for mounting and the gun mount comprising a damping and vibration-isolating mount with a woven wire isolator;

means for providing electrical actuating power to said rolling airframe missile launchers; and means for controlling store selection on said launchers.

3. A sidemounted rolling airframe missile launcher for mounting on a 5"/54 MK-45 gun mount comprising:

means for mounting rolling airframe missile launchers on a 5"/54 MK-45 gun mount;

means for isolating vibration between said means for mounting and the gun mount;

means for providing electrical actuating power to said rolling airframe missile launchers wherein actuator cables leading through the gun barrel trunions are attached to individual initiators and have swivel mechanisms attached to the actuator cables to rotate while maintaining electrical connection with the gun fire control system; and means for controlling store selection on said launchers;

* * * * *